US009690229B2

(12) United States Patent
Shimizu

(10) Patent No.: US 9,690,229 B2
(45) Date of Patent: Jun. 27, 2017

(54) IMAGE FORMING APPARATUS INCLUDING LAYER THICKNESS CONTROL PORTION TO CAUSE ROTATOR TO CARRY TONER, AND DEVELOPING DEVICE USED IN IMAGE FORMING APPARATUS

(71) Applicant: KYOCERA Document Solutions Inc., Osaka-shi, Osaka (JP)

(72) Inventor: Tamotsu Shimizu, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/239,650

(22) Filed: Aug. 17, 2016

(65) Prior Publication Data

US 2017/0052476 A1 Feb. 23, 2017

(30) Foreign Application Priority Data

Aug. 19, 2015 (JP) ..... 2015-162251

(51) Int. Cl.
*G03G 15/08* (2006.01)

(52) U.S. Cl.
CPC ..... *G03G 15/0812* (2013.01); *G03G 15/0806* (2013.01)

(58) Field of Classification Search
CPC ..... G03G 15/0812; G03G 15/0818; G03G 15/081; G03G 15/0808; G03G 15/0865
USPC ..... 399/284
See application file for complete search history.

(56) References Cited

U.S. PATENT DOCUMENTS

2004/0042813 A1* 3/2004 Takai ..... G03G 15/5004 399/88
2005/0196189 A1 9/2005 Matsuura et al.
2012/0237236 A1* 9/2012 Nakade ..... G03G 15/065 399/55
2013/0084108 A1* 4/2013 Suzuki ..... G03G 15/0812 399/274

FOREIGN PATENT DOCUMENTS

JP 2005250125 A 9/2005

* cited by examiner

*Primary Examiner* — Walter L Lindsay, Jr.
*Assistant Examiner* — Frederick Wenderoth
(74) *Attorney, Agent, or Firm* — Alleman Hall Creasman & Tuttle LLP

(57) ABSTRACT

An image forming apparatus includes a rotator, a driving control portion, and a layer thickness control portion. The rotator conveys toner to contact position to an image carrying member, and supplies toner to the image carrying member at the contact position. The driving control portion controls rotation of the rotator so as to rotate the rotator during a developing period, and stop the rotation of the rotator after a set time has elapsed since an end of the developing period. The layer thickness control portion causes the rotator to carry toner by controlling a potential difference between a potential of the rotator and a predetermined potential so that toner on the rotator at the contact position has a first layer thickness during the developing period and has a second layer thickness while the rotation of the rotator is stopped, the second layer thickness being thicker than the first layer thickness.

10 Claims, 8 Drawing Sheets

FIG. 5

81

| | PERIOD | | | | REDUCTION RATE OF STARTING TORQUE |
|---|---|---|---|---|---|
| | DEVELOPING PERIOD | POST-DEVELOPMENT PROCESSING PERIOD | LAYER THICKNESS VARYING PERIOD | STOP PERIOD | |
| EXAMPLE 1 | 360V | 360V | 460V | 460V | 20% |
| EXAMPLE 2 | 360V | 100V | 460V | 460V | 25% |
| COMPARATIVE EXAMPLE 1 | 360V | 360V | 360V | 360V | —— |

FIG. 6

82

| | | NUMBER OF PRINTED SHEETS (THRESHOLD W1) | | | | |
|---|---|---|---|---|---|---|
| | | 0 SHEETS | 5000 SHEETS | 10000 SHEETS | 20000 SHEETS | 50000 SHEETS |
| POTENTIAL DIFFERENCE ΔV1 IN LAYER THICKNESS VARYING PERIOD | SETTING EXAMPLE 1 | 460V | 460V | 460V | 460V | 460V |
| | SETTING EXAMPLE 2 | 460V | 480V | 500V | 500V | 500V |
| | COMPARATIVE EXAMPLE 2 | 360V | 360V | 360V | 360V | 360V |

IMAGE FORMING APPARATUS INCLUDING LAYER THICKNESS CONTROL PORTION TO CAUSE ROTATOR TO CARRY TONER, AND DEVELOPING DEVICE USED IN IMAGE FORMING APPARATUS

INCORPORATION BY REFERENCE

This application is based upon and claims the benefit of priority from the corresponding Japanese Patent Application No. 2015-162251 filed on Aug. 19, 2015, the entire contents of which are incorporated herein by reference.

BACKGROUND

The present disclosure relates to an image forming apparatus and a developing device for forming an image by the electrophotography.

There is known a developing device in which a developing roller rotates while in contact with a photoconductor. In this type of developing device, a large starting torque is required to cause the developing roller in a stop state to rotate. As a result, a motor for driving the developing roller needs to be able to output a large torque.

SUMMARY

An image forming apparatus according to an aspect of the present disclosure includes a rotator, a driving control portion, and a layer thickness control portion. The rotator is rotatably supported and configured to receive toner at a predetermined reception position, carry and convey the toner to a contact position at which the rotator contacts an image carrying member on which an electrostatic latent image is formed based on image data, and supply the toner to the image carrying member at the contact position. The driving control portion is configured to control rotation of the rotator so as to rotate the rotator during a developing period in which the electrostatic latent image is developed, and stop the rotation of the rotator after a predetermined set time has elapsed since an end of the developing period. The layer thickness control portion is configured to cause the rotator to carry the toner by controlling a potential difference between a potential of the rotator and a predetermined potential so that the toner on the rotator at the contact position has a first layer thickness during the developing period and has a second layer thickness while the rotation of the rotator is stopped, the second layer thickness being thicker than the first layer thickness.

A developing device according to another aspect of the present disclosure includes a rotator, a driving control portion, and a layer thickness control portion. The rotator is rotatably supported and configured to receive toner at a predetermined reception position, carry and convey the toner to a contact position at which the rotator contacts an image carrying member on which an electrostatic latent image is formed based on image data, and supply the toner to the image carrying member at the contact position. The driving control portion is configured to control rotation of the rotator so as to rotate the rotator during a developing period in which the electrostatic latent image is developed, and stop the rotation of the rotator after a predetermined set time has elapsed since an end of the developing period. The layer thickness control portion is configured to cause the rotator to carry the toner by controlling a potential difference between a potential of the rotator and a predetermined potential so that the toner on the rotator at the contact position has a first layer thickness during the developing period and has a second layer thickness while the rotation of the rotator is stopped, the second layer thickness being thicker than the first layer thickness.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 is a diagram showing values of the potential difference ΔV1 for the periods of an example 1 and an example 2 according to the first embodiment of the present disclosure.

FIG. 6 is a diagram showing setting examples of the potential difference ΔV1 for a layer thickness varying period in the example 1.

DETAILED DESCRIPTION

Figure 1:
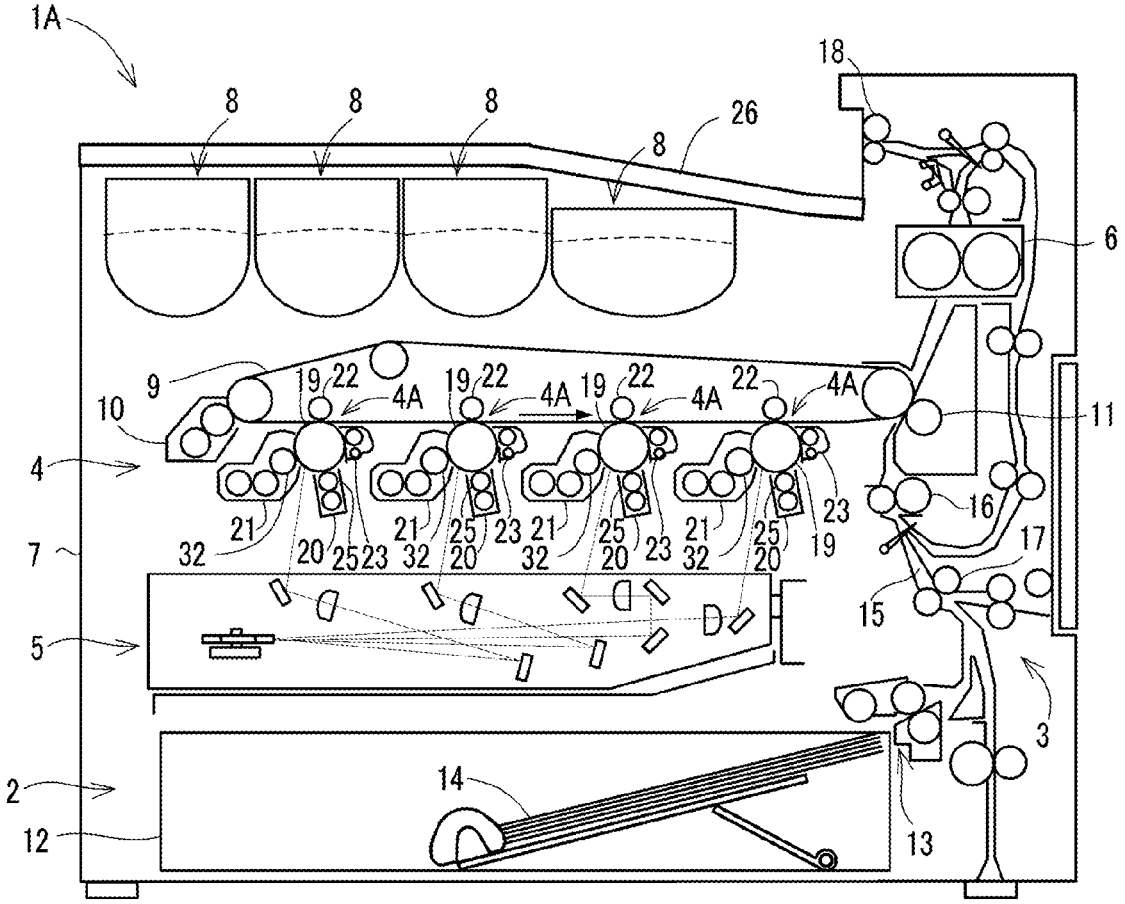
FIG. 1 is a schematic diagram showing a configuration of an image forming apparatus according to a first embodiment of the present disclosure.

The following describes embodiments of the present disclosure with reference to the attached drawings. It should be noted that the following embodiments are examples of specific embodiments of the present disclosure and should not limit the technical scope of the present disclosure.

First Embodiment

The configuration of an image forming apparatus 1A according to a first embodiment of the present disclosure is described with reference to FIG. 1 and FIG. 2. The image forming apparatus 1A is an electrophotographic image forming apparatus. The image forming apparatus 1A includes, in a housing 7, a sheet supply portion 2, a sheet conveyance portion 3, an image forming portion 4, an optical scanning portion 5, a fixing portion 6, and toner replenishing portions 8.

The image forming apparatus 1A is a tandem image forming apparatus, and is a color printer. As a result, the image forming portion 4 further includes an intermediate transfer belt 9, a cleaning device 10, and a secondary transfer device 11.

In addition, the image forming portion 4 includes a plurality of image forming units 4A respectively corresponding to colors of cyan, magenta, yellow, and black. The image forming apparatus 1A includes a plurality of toner replenishing portions 8 that respectively supply toner of colors of cyan, magenta, yellow, and black to developer storage portions 35 (see FIG. 2) of developing devices 21 that are described below. Toner is an example of the developer. The toner replenishing portions 8 are attached to the housing 7 of the image forming apparatus 1A in a detachable manner. In the present embodiment, after attachment, the toner replenishing portions 8 are located above the image forming portion 4.

It is noted that the image forming apparatus 1A may be a copier, a facsimile, or a multifunction peripheral having a plurality of functions such as a printer function, a facsimile function, and a scan function.

The sheet supply portion 2 includes a sheet storage portion 12 and a sheet feed portion 13. The sheet storage portion 12 can store a plurality of recording sheets 14 in stack. The recording sheets 14 are each a sheet-like image formation medium such as a sheet of paper, a sheet of coated paper, a postcard, an envelope, or an OHP sheet.

The sheet feed portion 13 is configured to rotate while in contact with the recording sheets 14, thereby feeding the recording sheets 14 from the sheet storage portion 12 to a conveyance path 15.

The sheet conveyance portion 3 includes a registration roller 16, a conveyance roller 17, and a discharge roller 18. The registration roller 16 and the conveyance roller 17 convey a recording sheet 14 supplied from the sheet supply portion 2, toward the secondary transfer device 11 of the image forming portion 4. Furthermore, the discharge roller 18 discharges a recording sheet 14 with an image formed thereon, onto a discharge tray 26 from a discharge port of the conveyance path 15.

The intermediate transfer belt 9 is an endless belt-like member formed in an annular shape. The intermediate transfer belt 9 rotates in the state of being suspended between two rollers. In the image forming portion 4, the image forming units 4A form images of respective colors on the surface of the intermediate transfer belt 9 while the belt is rotating. This allows images of the respective colors to be overlaid with each other, thereby forming a color image on the intermediate transfer belt 9. The intermediate transfer belt 9 is an example of the predetermined transfer object of the present disclosure.

The secondary transfer device 11 transfers the toner image formed on the intermediate transfer belt 9, to a recording sheet 14. The cleaning device 10 cleans the intermediate transfer belt 9 by removing toner that has remained on the intermediate transfer belt 9 after it passed through the secondary transfer device 11.

Each of the image forming units 4A includes a photoconductor drum 19 that carries the toner image, a charging device 20, a developing device 21, a primary transfer device 22, and a cleaning device 23. An electrostatic latent image is formed on the photoconductor drum 19 when the optical scanning portion 5 executes an exposure process of exposure-scanning the photoconductor drum 19 with a laser beam in lines repeatedly in the axial direction of the photoconductor drum 19 based on image data. The developing device 21 executes a developing process of developing the electrostatic latent image by supplying the toner to the photoconductor drum 19. The photoconductor drum 19 is an example of the image carrying member of the present disclosure. The primary transfer device 22 and the secondary transfer device 11 transfer the toner image formed on the photoconductor drum 19 to the recording sheet 14. The cleaning device 23 executes a cleaning process of removing toner that has remained on the photoconductor drum 19 after the primary transfer device 22 executed the transfer process. In addition, a discharger (not illustrated) executes an electricity removing process of removing charges that have remained on the surface of the photoconductor drum 19. As a result, in each of the image forming units 4A, processes such as the cleaning process and the electricity removing process are executed even after the developing process ends. Accordingly, the photoconductor drum 19 and the like are rotationally driven after the end of the developing process. The processes such as the cleaning process that are executed after the end of the developing process are collectively referred to as a post-development process.

Each photoconductor drum 19 rotates at a circumferential speed that corresponds to a circumferential speed (moving speed) of the intermediate transfer belt 9. The photoconductor drum 19 may be, for example, an amorphous silicon (a-Si) photoconductor or an organic photoconductor.

In each of the image forming units 4A, the photoconductor drum 19 rotates, and the charging device 20 uniformly charges the surface of the photoconductor drum 19. Furthermore, the optical scanning portion 5 scans the charged surface of the photoconductor drum 19 with a laser beam, thereby forming an electrostatic latent image on the surface of the photoconductor drum 19.

The developing device 21 develops the electrostatic latent image by supplying toner to the photoconductor drum 19. The developing device 21 charges the toner by stirring two-component developer that contains the toner and carrier, and supplies the charged toner to the photoconductor drum 19.

The charging device 20 includes a charging roller 25 that charges the photoconductor drum 19 before the electrostatic latent image is written thereto.

The image forming apparatus 1A is communicably connected to another communication device. The other communication device is, for example, a personal computer. The image forming apparatus 1A executes an image forming job requested from the other communication device. Job information of the image forming job includes information concerning the type of the image forming mode and the type of the recording sheet 14. The recording sheet 14 has types including normal paper and thick paper.

Figure 2:
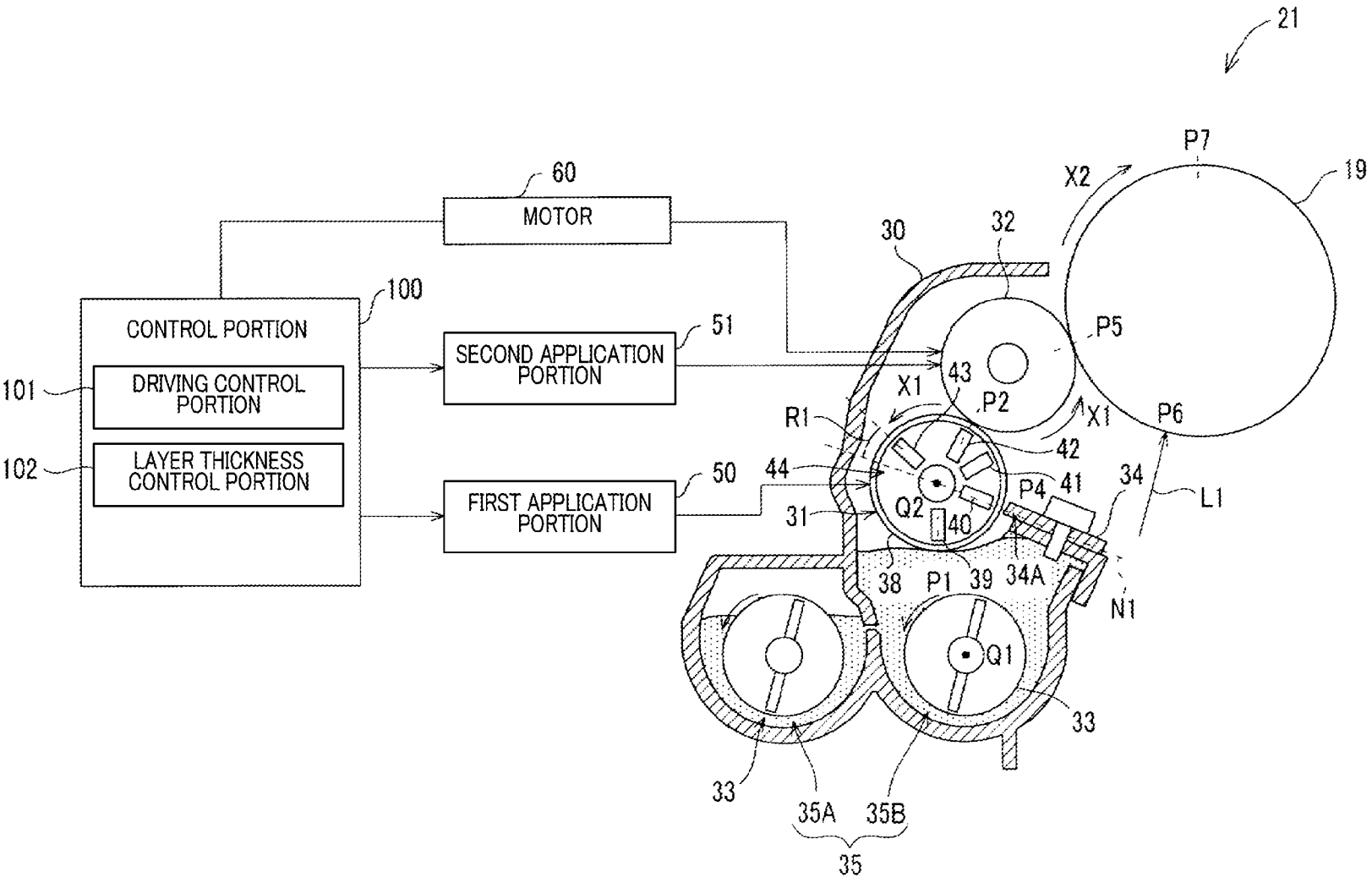
FIG. 2 is a schematic diagram showing a configuration of a developing device.

As shown in FIG. 2, the developing device 21 includes a device main body 30. In addition, the developing device 21 includes a magnetic roller 31, a developing roller 32, stirring members 33, and a restriction blade 34. These components are provided in the device main body 30. The magnetic roller 31, the developing roller 32, and the stirring members 33 are supported by the device main body 30 so as to be rotatable about respective rotation axes that are parallel to each other. In FIG. 2, point Q1, point Q2, and point Q3 represent the rotation axes of the magnetic roller 31, the developing roller 32, and a stirring member 33.

The device main body 30 is formed from resin. A lower part of the device main body 30 is a developer storage portion 35 for storing the two-component developer. The toner is supplied from the toner replenishing portion 8 (see FIG. 1). The developer storage portion 35 includes a storage chamber 35A and a storage chamber 35B.

The toner stored in the developer storage portion 35 is supplied from the toner replenishing portion 8 (see FIG. 1). Specifically, the toner supplied from the toner replenishing portion 8 is first supplied to the storage chamber 35A. Thereafter, the toner is conveyed by the stirring member 33 and supplied to the storage chamber 35B.

The toner is made of resin, and the carrier is made of a magnetic material. In addition, the toner is smaller than the carrier in particle diameter. The toner is smaller than the carrier in weight. The carrier is composed of magnetic particles of ferrite or the like. As described below, when a mixture of the carrier and the toner is stirred, static electricity is generated by the friction between the carrier and the toner, and the toner is charged with the static electricity. Compared to one-component developer which is composed of only toner, the two-component developer, with the presence of the carrier, can make the toner easy to be charged, which leads to a high-quality image. However, the developer stored in the developer storage portion 35 may be one-component developer. In addition, an external additive is added to the two-component developer. The external additive adheres to the surfaces of the toner particles. The external additive may be a metal oxide such as silica, alumina, titanium oxide, zinc oxide, or magnesium oxide.

The stirring members 33 are rotatably provided in the storage chamber 35A and the storage chamber 35B. The stirring members 33 stir the two-component developer stored in the storage chamber 35A and the storage chamber 35B. In the present embodiment, the stirring members 33 are screw members. The stirring members 33 are elongated and extending in a direction perpendicular to the plane of FIG. 2. It is noted that the stirring members 33 are made of resin. The stirring members 33 are rotatably supported by the device main body 30. As the stirring members 33 rotate, the two-component developer in the storage chamber 35A and the storage chamber 35B is stirred while being moved. When the two-component developer is stirred, the toner and the carrier cause friction, and the static electricity caused by the friction charges the toner to a predetermined polarity. In addition, the carrier is charged to an opposite polarity to the charging polarity of the toner. Due to the static electricity, the toner adheres to the carrier.

The magnetic roller 31 is rotatably provided in the developer storage portion 35. The magnetic roller 31 attracts, by the magnetic force, the two-component developer stirred by the stirring members 33 from the developer storage portion 35, and carries the developer on its surface.

The magnetic roller 31 includes a sleeve portion 38 and a magnetic pole portion 44.

The sleeve portion 38 has a cylindrical shape, and constitutes a surface of the magnetic roller 31. The sleeve portion 38 is composed of a non-magnetic member. The sleeve portion 38 is rotatable in forward and reverse directions. The sleeve portion 38 rotates in a rotation direction X1 during a developing period during which the developing process is executed. As described below, the photoconductor drum 19 rotates in a rotation direction X2 which is reverse to the rotation direction X1.

In the developing process, the developing roller 32 develops the electrostatic latent image formed on the surface of the photoconductor drum 19. The developing process is started at a timing when a front end portion of the electrostatic latent image in the rotation direction X2 that has been formed on the photoconductor drum 19 based on the image data, reaches position P5. A developing period starts at this timing. In the case where the image data included in the image forming job is composed of only one page, the front end portion is a first line portion of an electrostatic latent image that is formed based on the image data. In the case where the image data included in the image forming job is composed of a plurality of pages, the front end portion is a first line portion of an electrostatic latent image that is formed based on the first page among the plurality of pages for formation of the electrostatic latent image. In addition, the developing process ends at a timing when a rear end portion of the electrostatic latent image in the rotation direction X2 reaches position P5. The developing period ends at this timing. In the case where the image data included in the image forming job is composed of only one page, the rear end portion is a last line portion of an electrostatic latent image that is formed based on the image data. In the case where the image data included in the image forming job is composed of a plurality of pages, the rear end portion is a last line portion of an electrostatic latent image that is formed based on the last page among the plurality of pages for formation of the electrostatic latent image.

In the present embodiment, during the developing period, the sleeve portion 38 is rotationally driven in the rotation direction X1 in FIG. 2 (counterclockwise in FIG. 2).

The magnetic pole portion 44 includes a plurality of magnetic poles 39-43 that are provided in the sleeve portion 38. The plurality of magnetic poles are a draw-up pole 39, a restriction pole 40, a carrying pole 41, a main pole 42, and a peeling pole 43 that are arranged in alignment at predetermined intervals in the circumferential direction. The magnetic poles 39-43 are fixed in position in the inside of the sleeve portion 38. The magnetic poles 39-43 are, for example, permanent magnets that generate magnetic forces.

The draw-up pole 39 is a magnetic pole that generates a peak magnetic force at a position that faces the stirring member 33 of the storage chamber 35B. Specifically, the draw-up pole 39 generates the peak magnetic force in a direction of a line segment connecting the point Q1 and the point Q2. By the magnetic force generated by the draw-up pole 39, the two-component developer is attracted to and adsorbed on the surface of the sleeve portion 38. This causes the two-component developer to be carried on the surface of the sleeve portion 38. In this state, the sleeve portion 38 is rotated and the two-component developer is conveyed toward the downstream side in the rotation direction X1.

The restriction pole 40 is disposed adjacent to the draw-up pole 39 at a position that is more on the downstream side than the draw-up pole 39 in the rotation direction X1. In addition, the restriction pole 40, disposed at a position that faces a tip portion 34A of the restriction blade 34, magnetizes the restriction blade 34. This allows a magnetic field to be formed in a gap between the tip portion 34A of the restriction blade 34 and the restriction pole 40. When the two-component developer that has adhered to the surface of the sleeve portion 38 due to the magnetic force generated by the draw-up pole 39 passes through the gap, the two-component developer is magnetically constrained in the gap, and the layer thickness of the two-component developer is restricted by the tip portion 34A of the restriction blade 34. With this configuration, a developer layer having a uniform layer thickness is formed on the surface of the sleeve portion 38. In the developer layer, a magnetic brush (not illustrated) is formed. A plurality of carrier particles contained in the two-component developer form a chain erected on the surface of the magnetic roller 31, and the magnetic brush is formed from a plurality of chains of carrier particles.

The carrying pole 41 is disposed adjacent to the restriction pole 40 at a position that is more on the downstream side than the restriction pole 40 in the rotation direction X1. The carrying pole 41 causes the sleeve portion 38 to carry and convey the toner in a circumferential direction.

The main pole 42 is a magnetic pole that is disposed at a position that faces the developing roller 32, and generates a peak magnetic force at the position. As described below, the toner contained in the two-component developer transitions to the developing roller 32 at position P2, and the two-component developer that has remained on the magnetic roller 31 is kept to be attracted to the sleeve portion 38. As a result, the carrier attracted to the sleeve portion 38 by the carrying pole 41 maintains the state where the magnetic brush is formed.

The magnetic roller 31 and the developing roller 32 receive applications of different voltages. It is noted that in the present embodiment, the term "voltage" refers to a potential with respect to the ground. With the application of the different voltages, a potential difference is generated between the magnetic roller 31 and the developing roller 32, and between the developing roller 32 and the electrostatic latent image formed on the photoconductor drum 19. Due to the potential differences, the toner contained in the two-component developer carried by the magnetic roller 31 transitions to the developing roller 32. In FIG. 2, position P2 represents a transition position at which the toner contained in the two-component developer carried by the magnetic roller 31 transitions to the developing roller 32. Position P2 may also be called a reception position at which the developing roller 32 receives the toner from the magnetic roller 31 for carrying. Position P2 is an example of the reception position of the present disclosure.

As described above, the magnetic roller 31 is rotatably supported in the developer storage portion 35. The magnetic roller 31 rotates in the rotation direction X1 while carrying the two-component developer on its surface and conveying the toner to position P2, at which the toner contained in the two-component developer is passed to the developing roller 32.

The peeling pole 43 is a magnetic pole that forms, on the surface of the sleeve portion 38, a peeling region R1 where the magnetic flux density is substantially zero. When the two-component developer is conveyed to the peeling region R1, the force with which the sleeve portion 38 causes the toner contained in the two-component developer to adhere is lost, and the toner is apt to peel off the peeling region R1.

The magnetic roller 31 receives the two-component developer from the storage chamber 35B at position P1 by the magnetic force of the draw-up pole 39, and conveys the two-component developer by the rotation of the sleeve portion 38 in the rotation direction X1. When the two-component developer is conveyed to position P2, the toner contained in the two-component developer transitions to the developing roller 32 by a potential difference $\Delta V1$ between the magnetic roller 31 and the developing roller 32. At this time, the carrier remains on the surface of the magnetic roller 31.

The magnetic roller 31 conveys the two-component developer toward the downstream side by a further rotation of the sleeve portion 38 in the rotation direction X1. After conveying the two-component developer to the peeling region R1, the magnetic roller 31 causes the two-component developer to peel off the magnetic roller 31 by the repulsion that occurs between the carrier and the peeling pole 43. The two-component developer having peeled off drops into the storage chamber 35B that is located below. The two-component developer that dropped is conveyed again while being stirred by the stirring member 33. After stirred and conveyed by the stirring member 33, the two-component developer contains uniformly charged toner with appropriate toner density again, and is drawn up onto the sleeve portion 38 again by the draw-up pole 39.

The restriction blade 34 is a plate-like member configured to restrict the layer thickness of the two-component developer carried on the surface of the magnetic roller 31. The restriction blade 34 is disposed in an attitude of extending along a normal line N1 shown in FIG. 2. The normal line N1 is normal at a position facing the restriction pole 40 on a circle that is an outer circumference of the magnetic roller 31 in a cross section. The restriction blade 34 is an example of the layer thickness restricting member of the present disclosure. The tip portion 34A of the restriction blade 34 is disposed at a position P4 with a gap from the surface of the magnetic roller 31, wherein position P4 is more on the upstream side than position P2 in the rotation direction X1, and is more on the downstream side than position P1 in the rotation direction X1. The restriction blade 34 restricts the layer thickness of the two-component developer carried by the magnetic roller 31 that rotates in the rotation direction X1. Position P4 is a restriction position at which the restriction blade 34 restricts the layer thickness of the two-component developer carried by the magnetic roller 31 that rotates in the rotation direction X1.

The developing roller 32 is disposed to face the magnetic roller 31, receives, from the magnetic roller 31, the toner contained in the two-component developer that has been carried by the magnetic roller 31, and carries the received toner. A toner layer is formed on the surface of the developing roller 32.

The surface of the developing roller 32 is a rubber layer having electric conductivity. The rubber layer has hardness within a range of 40 to 60 degrees. The developing roller 32 is in contact with the photoconductor drum 19. In FIG. 2, position P5 represents a contact position at which the developing roller 32 contacts the photoconductor drum 19.

A motor 60 is, for example, a stepping motor. The developing roller 32 and the photoconductor drum 19 are rotated by the driving force of the motor 60. The developing roller 32 rotates in the rotation direction X1, and the photoconductor drum 19 rotates in the rotation direction X2 that is reverse to the rotation direction X1. The motor 60 causes the developing roller 32 to rotate such that there is a predetermined speed difference between the circumferential speed of the developing roller 32 and the circumferential speed of the photoconductor drum 19.

As described above, a voltage is applied to the developing roller 32. This causes a predetermined potential difference to be generated between the developing roller 32 and the electrostatic latent image formed on the photoconductor drum 19. Due to this potential difference, at position P5, the toner carried on the developing roller 32 transitions to the electrostatic latent image formed on the circumferential surface of the photoconductor drum 19. The electrostatic latent image is formed at position P6 that is more on the upstream side than position P5 in the rotation direction X2 of the photoconductor drum 19. The developing roller 32 conveys the toner to position P5 at which the toner is supplied to the photoconductor drum 19 on whose surface the electrostatic latent image is formed. The developing roller 32 is an example of the rotator of the present disclosure.

The developing roller 32 rotates in the same direction as the rotation direction X1 of the magnetic roller 31 during the developing period. Therefore, a portion on the circumferential surface of the magnetic roller 31 and a portion on the circumferential surface of the developing roller 32 that face each other move in the reverse direction. The rotation direction X1 is reverse to the rotation direction X2 of the photoconductor drum 19. Therefore, a portion on the circumferential surface of the photoconductor drum 19 and a portion on the circumferential surface of the developing roller 32 that face each other move in the same direction.

As described above, the toner contained in the two-component developer is consumed in the developing process. As a result, toner is replenished from the toner replenishing portions 8 to the developer storage portion 35 so that the consumed amount of toner is replenished. On the other hand, the carrier contained in the two-component developer is hardly consumed and remains in the developer storage portion 35, giving fluidity and the like to the toner replenished into the developer storage portion 35.

The image forming apparatus 1A includes a first application portion 50 and a second application portion 51. Although not shown in the drawings, the first application portion 50 and the second application portion 51 each include a DC power source, an AC power source, and a voltage varying device. The first application portion 50 applies a voltage V1 to the magnetic roller 31. The voltage V1 includes a DC-component voltage and an AC-component voltage. The second application portion 51 applies a voltage V2 that is different from the voltage V1, to the developing roller 32. The voltage V2 includes a DC-component voltage and an AC-component voltage.

With the application of the voltages V1 and V2 by the first application portion 50 and the second application portion 51, a potential difference is generated between the magnetic roller 31 and the developing roller 32, and between the developing roller 32 and the electrostatic latent image formed on the photoconductor drum 19, as described above. Due to the potential differences, electric fields are formed. The toner charged by the electric field transitions from the magnetic roller 31 to the developing roller 32, and transitions from the developing roller 32 to the photoconductor drum 19. In FIG. 2, a position P7 represents a position at which the toner transitions from the photoconductor drum 19 to the intermediate transfer belt 9.

The image forming apparatus 1A includes a control portion 100. The control portion 100 includes a CPU, a ROM, and a RAM. The CPU is a processor that executes various calculation processes. The ROM is a nonvolatile storage medium in which various information such as control programs for causing the CPU to execute various processes are stored in advance. The RAM is a volatile storage portion that is used as a temporary storage memory (working area) for the various processes executed by the CPU. In the control portion 100, the CPU executes the control programs stored in the ROM, thereby controlling the operation of the image forming apparatus 1A.

The ROM of the control portion 100 stores a processing program for causing the CPU of the control portion 100 to execute a layer thickness control process (see the flowchart of FIG. 3) that is described below. The processing program may be stored in the ROM at the time of the shipment of the image forming apparatus 1A. Alternatively, the processing program may be recorded on a computer-readable information recording medium such as a CD, a DVD, or a flash memory, and after the shipment, the processing program may be stored into the ROM of the control portion 100 from the information recording medium.

Meanwhile, in the case where the developing roller 32 is configured to rotate while in contact with the photoconductor drum 19, a large starting torque is required for the motor 60 to drive and rotate the developing roller 32 in the stop state. As a result, the motor 60 needs to be able to output a large torque. The starting torque will be reduced if the toner layer formed on the developing roller 32 is made to have a large thickness. However, a so-called "fogging" may occur during the developing process, if the toner layer on the developing roller 32 is made to be thick both when the electrostatic latent image on the photoconductor drum 19 is developed and when the developing roller 32 is in the stop state. On the other hand, according to the present embodiment, it is possible to reduce the starting torque required to rotate the developing roller 32 in the stop state, and supply an appropriate amount of toner to the photoconductor drum 19 during the developing process.

The control portion 100 includes a driving control portion 101 and a layer thickness control portion 102, which is realized when the CPU executes the processing programs stored in the ROM. It is noted that one or more functions of the control portion 100 may be provided as an electronic circuit. The driving control portion 101 and the layer thickness control portion 102 may be provided in the developing device 21.

The driving control portion 101 controls the rotation of the developing roller 32. The driving control portion 101 rotates the developing roller 32 during the developing period, and stops the rotation of the developing roller 32 after a predetermined set time has elapsed since the end of the developing period. Specifically, in the present embodiment, during the developing period, the driving control portion 101 rotates the developing roller 32 in the rotation direction X1 that is reverse to the rotation direction X2 of the photoconductor drum 19, at a predetermined circumferential speed ratio to the rotation speed of the photoconductor drum 19. When the developing period ends, the driving control portion 101 rotates the developing roller 32 as many times as a predetermined number of rotations, namely, for a predetermined time period immediately after the end of the developing period, to perform the post-development process. Here, the predetermined time period is referred to as a post-development processing time. After the post-development process is completed, the driving control portion 101 executes a layer thickness varying process that is described below, and then stops the rotation of the developing roller 32. A time required for the post-development process to be executed after the end of the developing period is an example of the first time of the present disclosure. A time required for the layer thickness varying process to be executed is an example of the second time of the present disclosure. A time required for the layer thickness varying process to be executed is referred to as a layer thickness varying time. The period for which the rotation of the developing roller 32 is stopped is referred to as a stop period. When a necessity for the image forming process arises during the stop period, the driving control portion 101 controls the motor 60 to rotate the developing roller 32.

The layer thickness control portion 102 controls the potential difference ΔV1 between the voltage V1 of the magnetic roller 31 and the voltage V2 of the developing roller 32 by controlling the first application portion 50 and the second application portion 51. Specifically, the layer thickness control portion 102 causes the developing roller 32 to carry the toner by controlling the potential difference ΔV1 such that the toner layer on the developing roller 32 at position P5 has a first layer thickness TH1 during the developing period during which the electrostatic latent image passes position P5. In addition, the layer thickness control portion 102 causes the developing roller 32 to carry the toner by controlling the potential difference ΔV1 such that the toner layer on the developing roller 32 at position P5 has a second layer thickness TH2 when the rotation of the developing roller 32 is stopped, the second layer thickness TH2 being thicker than the first layer thickness TH1. The potential of the magnetic roller 31 is an example of the predetermined potential of the present disclosure. In the present embodiment, the larger the potential difference ΔV1 is, the thicker the toner layer is. Details are described below.

Figure 3:
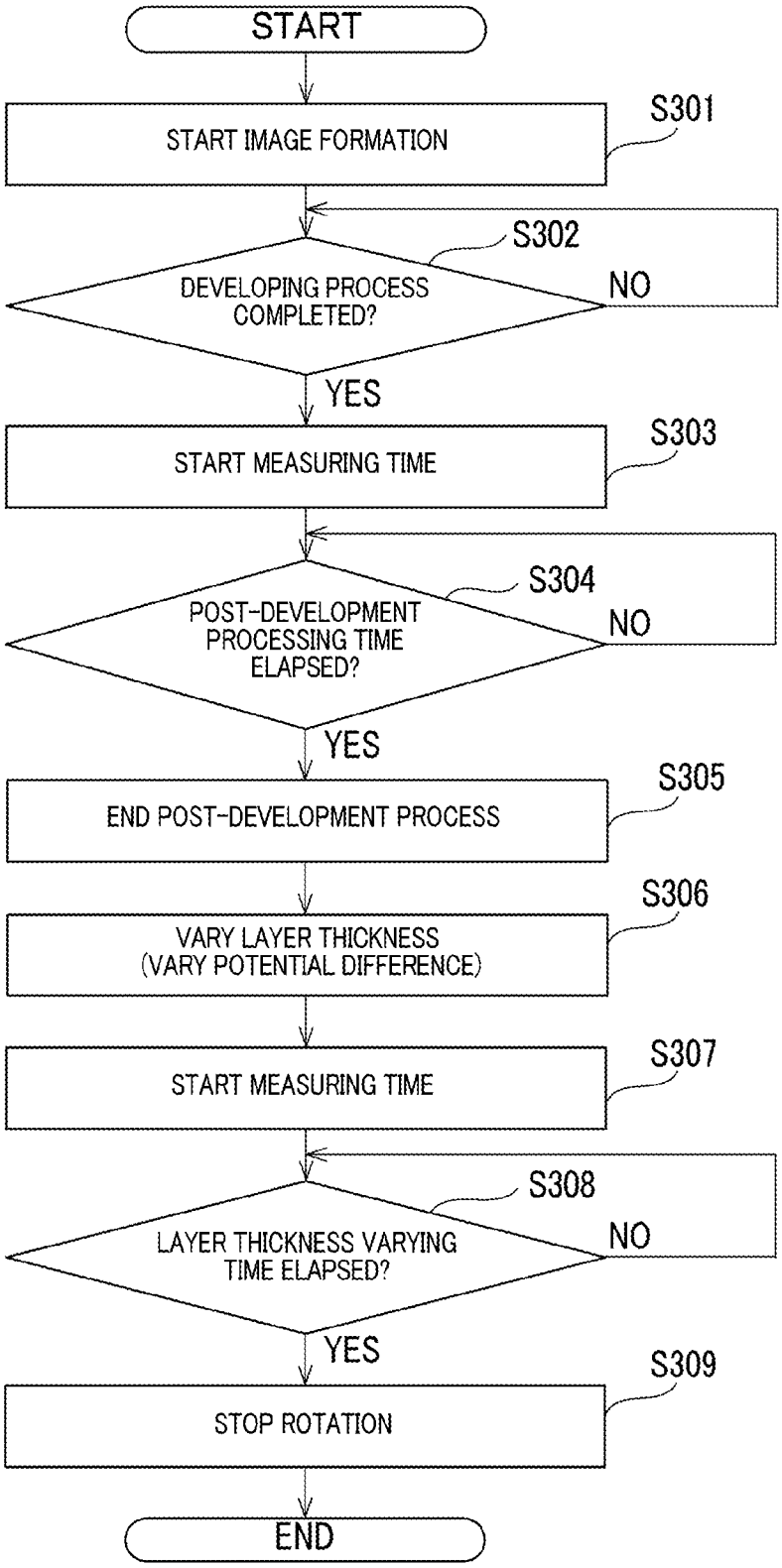
FIG. 3 is a flowchart showing a layer thickness control process executed by a control portion.

Next, an example of the layer thickness control process executed by the control portion 100 is described with reference to FIG. 3 and FIG. 4. It is noted that steps S301, S302, . . . in the flowchart of FIG. 3 represent processing procedures (step numbers), and the processing of the flowchart of FIG. 3 starts to be executed when the control portion 100 receives an operation signal instructing to start an execution of an image forming job. It is supposed here that the image forming job includes one page of image data. In addition, in FIG. 4, "ON" indicates that the process is executed, and "OFF" indicates that the process is stopped.

<Step S301>

In step S301, the control portion 100 causes the image forming portion 4 to start executing the image forming process. The control portion 100 rotates the photoconductor drum 19, the developing roller 32 and the like. The developing roller 32 rotates in the rotation direction X1 at a predetermined circumferential speed ratio to the rotation speed of the photoconductor drum 19. It is noted that the process of rotating the developing roller 32 is executed by the driving control portion 101. In addition, the control portion 100 rotates the developing roller 32, and sets the potential difference ΔV1 between the magnetic roller 31 and the developing roller 32 to a potential difference ΔV11 by controlling the first application portion 50 and the second application portion 51. This allows the thickness of the toner on the circumferential surface of the developing roller 32 to be varied to the first layer thickness TH1. The electrostatic latent image formed on the photoconductor drum 19 is developed by the toner having the first layer thickness TH1. It is noted that this process is executed by the layer thickness control portion 102.

In addition, the control portion 100 starts causing an electrostatic latent image to be formed on the photoconductor drum 19. Here, the timing at which to start causing an electrostatic latent image to be formed is a timing at which the front end portion of the electrostatic latent image formed on the photoconductor drum 19 reaches position P2 after a timing at which the toner having the first layer thickness TH1 reaches position P2. When the front end portion of the electrostatic latent image reaches position P2, the developing process starts and the developing period starts.

<Step S302>

In step S302, the control portion 100 determines whether or not the developing process for the image data included in the image forming job has been completed. That is, the control portion 100 determines whether or not the developing has been completed with respect to the rear end portion of the electrostatic latent image in the rotation direction X1 among the electrostatic latent image formed on the photoconductor drum 19 in correspondence with the image data included in the image forming job.

This determination is performed base on a timing at which the rear end portion of the electrostatic latent image is formed on the photoconductor drum 19. More specifically, the control portion 100 determines whether or not a time period TL3 has elapsed since a timing at which the rear end portion of the electrostatic latent image was formed on the photoconductor drum 19 at position P6, wherein the time period TL3 is required for the rear end portion of the electrostatic latent image to reach position P5. The time period TL3 is represented as TL3=D2/SP2, wherein SP2 represents the circumferential speed of the photoconductor drum 19, and D2 represents the circumferential length of the photoconductor drum 19 from position P6 to position P5 in the rotation direction X2. Upon determining that the developing process has been completed (YES at step S302), the control portion 100 moves the process to step S303.

<Step S303>

In step S303, the control portion 100 starts measuring time.

<Step S304>

In step S304, after the developing period ends, the control portion 100 determines whether or not the post-development processing time has elapsed. Upon determining that the post-development processing time has elapsed (YES at step S304), the control portion 100 moves the process to step S305.

<Step S305>

In step S305, the control portion 100 ends the post-development process. In addition, the control portion 100 ends measuring time, and resets the measured time.

<Step S306>

In step S306, the control portion 100 sets the potential difference ΔV1 between the magnetic roller 31 and the developing roller 32 to a potential difference ΔV12 by controlling the first application portion 50 and the second application portion 51. This allows the thickness of the toner on the circumferential surface of the developing roller 32 to be varied to the second layer thickness TH2. The second layer thickness TH2 is thicker than the first layer thickness TH1 and thinner than twice the first layer thickness TH1. From this time, the control portion 100 maintains the layer thickness of the toner carried on the developing roller 32 to the second layer thickness TH2 until the rotation is stopped. In addition, the process is executed by the layer thickness control portion 102. Furthermore, the control portion 100 continues to rotate the developing roller 32.

<Step S307>

In step S307, the control portion 100 starts measuring time.

<Step S308>

In step S308, the control portion 100 determines whether or not the layer thickness varying time has elapsed since the start of the measurement of time. In the present embodiment, the layer thickness varying time matches a conveyance time period TL2 (see FIG. 4) that is required for the developing roller 32 to convey the toner from position P2 to position P5 in the rotation direction X1. That is, the layer thickness varying time is set to the same time period as the conveyance time period TL2 (=TL2). The conveyance time period TL2 is represented as TL2=D1/Cv1, wherein Cv1 represents the circumferential speed of the developing roller 32, and D1 represents the circumferential length of the developing roller 32 from position P2 to position P5 in the rotation direction X1. It is noted that the layer thickness varying time may be longer than D1/Cv1. Upon determining that the layer thickness varying time has elapsed (YES at step S308), the control portion 100 moves the process to step S309.

<Step S309>

In step S309, the control portion 100 stops the rotation of the developing roller 32 and the photoconductor drum 19. In addition, the control portion 100 ends measuring time, and resets the measured time. It is noted that although in the present embodiment, the potential difference ΔV1 is maintained to the potential difference ΔV12 even during the stop period during which the rotation of the developing roller 32 is stopped, the potential difference ΔV1 may be different from the potential difference ΔV12 during the stop period.

Figure 4:
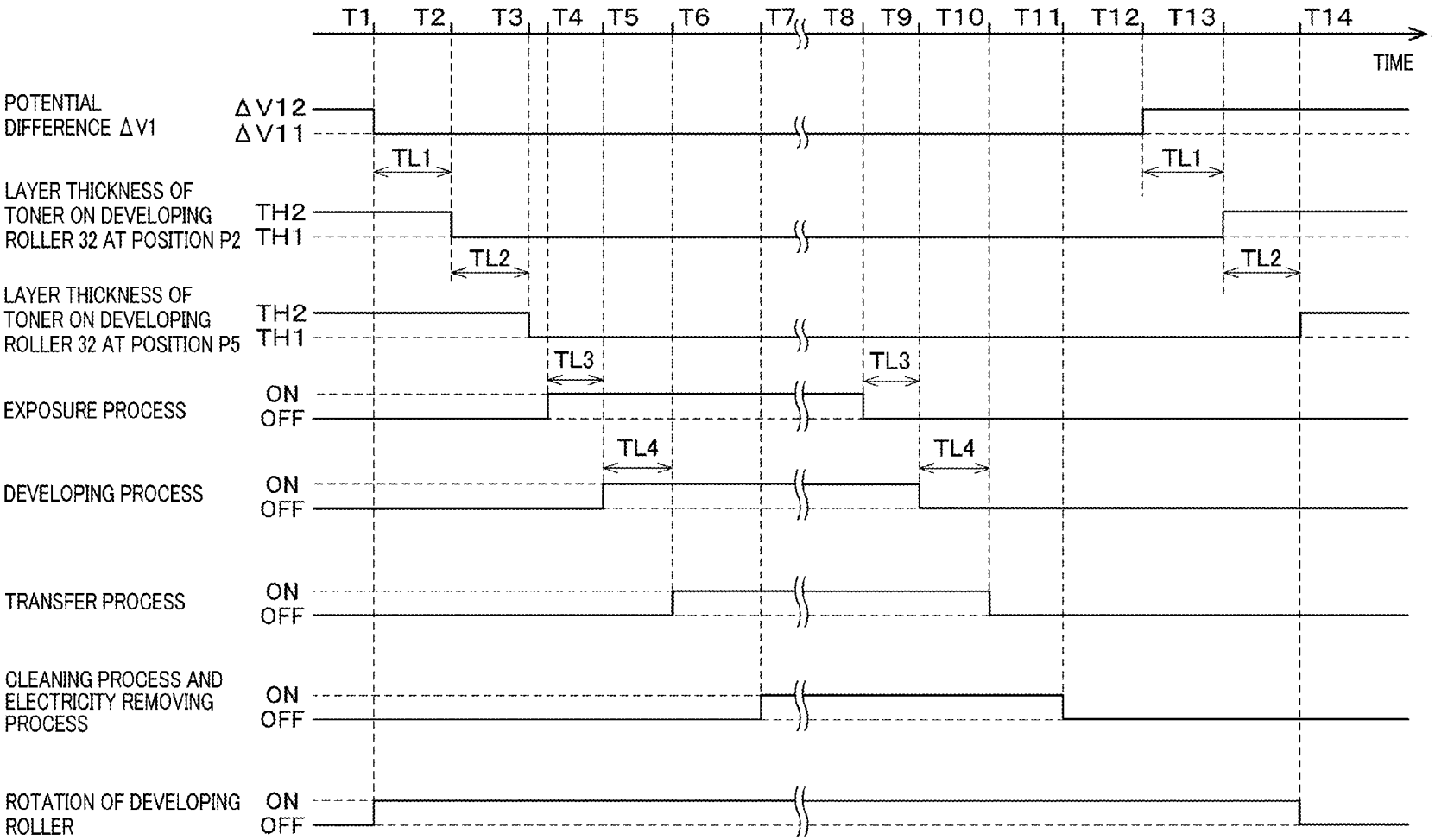
FIG. 4 is a timing chart showing timings of variation of a potential difference ΔV1, variation of layer thickness of toner on the developing roller at position P2, variation of layer thickness of toner on the developing roller at position P5, an exposure process, a developing process, a transfer process, a post-development process, and a rotation operation of the developing roller according to the first embodiment of the present disclosure.

Next, with reference to FIG. 4, a description is given of the timings of variation of the potential difference ΔV1, variation of layer thickness of toner on the developing roller 32 at position P2, variation of layer thickness of toner on the developing roller 32 at position P5, the exposure process, the developing process, the transfer process, the post-development process, and the rotation operation of the developing roller 32. FIG. 4 is a timing chart showing the processes and the operations.

As shown in FIG. 4, at time T1, the control portion 100 sets the potential difference ΔV1 to the potential difference ΔV11 and starts rotating the developing roller 32. Due to this, at time T2, at which a predetermined time period TL1 has elapsed since the time T1, the layer thickness of the toner on the developing roller 32 at position P2 varies from the second layer thickness TH2 to the first layer thickness TH1. Subsequently, at time T3, at which a time period TL2 has elapsed since the time T2, the toner having the first layer thickness TH1 on the developing roller 32 reaches position P5 on the developing roller 32. The time period TL1 is represented as TL1=D2/Cv2, wherein Cv2 represents the circumferential speed of the magnetic roller 31, and D2 represents the circumferential length of the magnetic roller 31 from position P1 to position P2 in the rotation direction X1.

On the other hand, at time T4 after time T3, the control portion 100 causes the optical scanning portion 5 to start forming an electrostatic latent image at position P6 on the photoconductor drum 19. At time T5, at which a predetermined time period TL3 has elapsed since the time T4, the front end portion of the electrostatic latent image reaches position P5. The developing process is started from time T5. That is, the developing period starts from the time T5. At time T6, at which a predetermined time period TL4 has elapsed since the time T5, the transfer process is started, wherein in the transfer process, a toner image formed on the photoconductor drum 19 is transferred to the intermediate transfer belt 9. The time period TL4 is represented as TL4=D3/SP2, wherein SP2 represents the circumferential speed of the photoconductor drum 19, and D3 represents the circumferential length of the photoconductor drum 19 from position P5 to position P7 in the rotation direction X2. It is noted that the time T4 does not necessarily be later than the time T3 as far as it is a time at which the toner that has transitioned to the developing roller 32 reaches position P5 after the toner having the first layer thickness TH1 that was started to be formed at time T1 reaches position P5. At time T7 after time T6, the cleaning process and the electricity removing process are executed.

At time T8, the control portion 100 causes the optical scanning portion 5 to end forming the electrostatic latent image. At time T9, at which the time period TL3 has elapsed since the time T8, the rear end portion of the electrostatic latent image formed on the photoconductor drum 19 reaches position P5. Here, the time T8 has been calculated by the control portion 100 in advance. That is, upon receiving an image forming job, the control portion 100 calculates, in advance, a time required to form an electrostatic latent image in response to the image data included in the image forming job, based on the data amount of the image data. The control portion 100 calculates the time T8 by adding the calculated time to the time T4.

At time T9, the developing process, namely, the developing period ends. The control portion 100 calculates the time T9 in advance based on the time T8. The time T9 is obtained by adding the time period TL3 to the time T8. At time T10, at which the time period TL4 has elapsed since the time T9, the rear end portion of the toner image is transferred to the intermediate transfer belt 9, and the transfer process ends. In addition, at time T11, at which a predetermined time period has elapsed since the time T10, the post-development process ends.

At time T12 after time T11, the control portion 100 sets the potential difference ΔV1 between the magnetic roller 31 and the developing roller 32 to the potential difference ΔV12 by controlling the first application portion 50 and the second application portion 51. Due to this, at time T13, at which the predetermined time period TL1 has elapsed since the time T12, the layer thickness of the toner on the developing roller 32 at position P2 varies to the second layer thickness TH2. Furthermore, at time T14, at which the time period TL2 has elapsed since the time T13, the toner having the second layer thickness TH2 on the developing roller 32 reaches position P5 on the developing roller 32. At the time T14, the driving control portion 101 stops the rotation of the developing roller 32. The time period from the time T9 to the time T14 is an example of the predetermined set time of the present disclosure.

As described above, in the present embodiment, the layer thickness control process is performed such that the toner layer on the developing roller 32 at position P5 has the second layer thickness TH2 that is thicker than the first layer thickness TH1 when the rotation of the developing roller 32 is stopped. With this configuration, when the rotation of the developing roller 32 is restarted, the amount of toner between the developing roller 32 and the photoconductor drum 19 is larger than the amount of toner in the case of the first layer thickness TH1.

Since, as described above, the surface of the developing roller 32 is made of rubber, the surface of the developing roller 32 is recessed at position P5 where it contacts the photoconductor drum 19. If toner is present between the recessed portion of the surface of the developing roller 32 and the photoconductor drum 19, at least a part of a force that would be given from the photoconductor drum 19 and the developing roller 32 to each other if the toner were not present therebetween, is absorbed by the toner when the developing roller 32 and the photoconductor drum 19 rotate. The larger the amount of toner present therebetween is, the larger the amount of force absorbed by the toner is, and the less the friction in the rotation direction that acts between the developing roller 32 and the photoconductor drum 19 is. As in the present embodiment, with the configuration where the toner layer at position P5 becomes thicker than during the developing period at a timing when the rotation of the developing roller 32 is stopped, a more amount of toner is present between the recessed portion of the surface of the developing roller 32 and the photoconductor drum 19 than during the developing period. This causes the amount of toner between the recessed portion and the photoconductor drum 19 to increase. As a result, due to the increase of the toner present therebetween, the amount of the recess of the developing roller 32 increases when the developing roller 32 is pressed toward the center, and the area in which the toner is present between the recessed portion of the developing roller 32 and the photoconductor drum 19 is broadened. In the present embodiment, the developing roller 32 and the photoconductor drum 19 are stopped in the state where a more amount of toner is present between the developing roller 32 and the photoconductor drum 19 than during the developing period. As a result, when the developing roller 32 and the photoconductor drum 19 are rotationally driven again, the developing roller 32 and the photoconductor drum 19 start to rotate in the state where the friction in the rotation direction is small. Accordingly, it is possible to reduce the starting torque compared to a conventional layer-thickness control in which toner having the second layer thickness TH2 is not provided.

In the following, example 1 and example 2 that are specific examples of the first embodiment are described. FIG. 5 is a table 81 showing values of the potential difference ΔV1 in the above-described periods of the example 1 and the example 2.

As shown in the table 81, specific configurations of the developing device 21 and control conditions for the potential difference ΔV1 in the example 1 and the example 2 are as follows. The developing roller 32 is 16 mm in diameter, the rubber layer is made of urethane rubber, and the rubber layer is 5 mm in thickness and 55 degrees in hardness. In addition, the fogging will occur when the surface resistance of the developing roller 32 is $1.0\times10^6\Omega$ or more. As a result, the surface resistance needs to be less than $1.0\times10^6\Omega$, and in the example 1 and the example 2, the surface resistance is $1.0\times10^5\Omega$. In addition, at position P2 where the developing roller 32 and the magnetic roller 31 are closest to each other, the distance therebetween is 0.3 mm.

The photoconductor drum 19 is an amorphous silicon photoconductor. On the photoconductor drum 19, the voltage at a white background portion is +230 V, and the voltage at the electrostatic latent image portion is +20 V. The circumferential speed ratio of the rotation speed of the developing roller 32 to the rotation speed of the photoconductor drum 19 is 2. In addition, the circumferential speed ratio of the rotation speed of the magnetic roller 31 to the rotation speed of the developing roller 32 is 1.1.

Pressed by the photoconductor drum 19, the developing roller 32 is deformed. Here, when an amount of the deformation exceeds 0.1 mm, the starting torque becomes excessively large. Conversely, when the amount of the deformation is less than 0.025 mm, the deformed state of the developing roller 32 becomes unstable, and a density unevenness occurs to the image. As a result, to avoid such defects, the amount of the deformation needs to be in a range from 0.025 mm to 0.1 mm. In the example 1 and the example 2, the amount of the deformation is adjusted to be 0.05 mm within the range.

With regard to the voltage applied from the second application portion 51 to the developing roller 32, the DC component is 110 V, a peak-to-peak voltage of the AC component is 170 V, the duty ratio of the AC component is 45%, and the frequency of the AC component is 3.7 kHz. In addition, with regard to the potential difference ΔV1 between the voltage V1 of the magnetic roller 31 and the voltage V2 of the developing roller 32, a peak-to-peak voltage of the AC component is 2500 V, the duty ratio of the AC component is 70%, and the frequency of the AC component is 3.7 kHz. The print speed is rated at 50 sheets of recording sheets 14 per minute.

In addition, in the example 1 and the example 2, values of the DC component of the potential difference ΔV1 are set respectively for the developing period, the post-development processing period, the layer thickness varying period, and the stop period, as shown in FIG. 5. That is, in the example 1, values of the DC component of the potential difference ΔV1 for the developing period and the post-development processing period are set to 360 V. In addition, values of the DC component of the potential difference ΔV1 for the layer thickness varying period and the stop period are set to 460 V.

The example 2 differs from the example 1 in that the value of the DC component of the potential difference ΔV1 is set to 100 V for the post-development processing period. Otherwise, the example 2 is the same as the example 1. That is, in the example 2, before the toner layer thickness in the layer thickness varying period is made thicker than in the developing period, the potential difference ΔV1 is once made smaller than in the developing period. With this configuration, during the post-development processing period, the layer thickness control portion 102 causes the developing roller 32 to carry the toner having a third layer thickness TH3 that is thinner than the first layer thickness TH1.

The toner that has remained on the surface of the developing roller 32 after the developing period contains much toner particles from which the external additive has separated. When the external additive separates from toner particles, the fluidity of the toner particles is reduced. When the fluidity is reduced, the starting torque increases.

In the example 2, the potential difference ΔV1 is once made smaller than the potential difference ΔV11 of the developing period so that the magnetic roller 31 can collect the toner particles whose fluidity has decreased due to the separation of the external additive. Thereafter, in the layer thickness varying period, the toner particles with the external additive adhered thereto are supplied to the developing roller 32. It is noted that the values of the DC component of the potential difference ΔV1 in the other periods are the same as those of the example 1.

A comparative example 1 shown in FIG. 5 is an example of the case where the thickness of the toner is not made thicker than during the developing period before the rotation of the developing roller 32 is stopped, namely, the case where the layer thickness varying period provided in the present embodiment is not provided. The configuration of the comparative example 1 is the same as that of the example 1 and the example 2, except for the set value of the potential difference ΔV1.

The starting torque for zero print was measured for each of the example 1, the example 2, and the comparative example 1, and the measurement results were compared. It was confirmed that, with the starting torque of the comparative example 1 for zero print being set as a reference torque, in the example, 1, the starting torque at the restart of the rotation of the developing roller 32 was reduced by 20% from the reference torque for zero print. It is noted that the reduction rate of the starting torque was calculated based on the driving current of the motor 60.

In addition, it was confirmed, from the comparison between the example 2 and the comparative example 1, that, in the example 2, the starting torque at the restart of the rotation of the developing roller 32 was reduced by 25% from the starting torque for zero print. That is, it was confirmed that the starting torque was more reduced in the example 2 than in the example 1. That is, it was confirmed that the example 2 produces a larger effect of reducing the starting torque than the example 1.

Meanwhile, the contact friction between the photoconductor drum 19 and the developing roller 32 increases in response to an increase of the cumulative value of the number of printed sheets (hereinafter, merely referred to as "the number of printed sheets") in the image forming apparatus 1A. When the contact friction increases, the starting torque increases.

In view of the above, the control portion 100 (the layer thickness control portion 102) may increase the amount of toner that is carried by the developing roller 32 during the layer thickness varying period in response to the increase of the contact friction between the photoconductor drum 19 and the developing roller 32. Specifically, the control portion 100 (the layer thickness control portion 102) may increase the amount of toner that is carried by the developing roller 32 during the layer thickness varying period in response to an increase of the number of printed sheets. For example, when the number of printed sheets reaches a predetermined threshold W1, the amount of toner carried by the developing roller 32 during the layer thickness varying period may be increased. That is, in the present embodiment, when the number of printed sheets reaches the predetermined threshold W1, the control portion 100 varies the potential difference ΔV12 for zero print to a potential difference ΔV14 that is larger than the potential difference ΔV12. With this operation, the control portion 100 changes the thickness of the toner layer on the developing roller 32 when the rotation of the developing roller 32 is stopped, from the second layer thickness TH2 to a fourth layer thickness TH4. The determination process in which the control portion 100 determines whether or not the number of printed sheets has reached the threshold W1 is executed in, for example, step S307 of the flowchart shown in FIG. 3. Upon determining that the number of printed sheets has reached the threshold W1, the control portion 100 changes the potential difference ΔV1 during the layer thickness varying period, from the potential difference ΔV11 to the potential difference ΔV14, not to the potential difference ΔV12. It is noted that upon determining that the number of printed sheets has not reached the threshold W1, the control portion 100 changes the potential difference ΔV1 during the layer thickness varying period, from the potential difference ΔV11 to the potential difference ΔV12.

Furthermore, a plurality of combinations of potential difference ΔV1 and threshold W1 of the number of printed sheets may be prepared. In other words, the potential difference ΔV1 may be varied in response to the increase of the number of printed sheets. In the present embodiment, the larger the threshold W1 is, the larger the potential difference ΔV14 is.

In the case where the potential difference ΔV1 has a constant value regardless of the number of printed sheets during the layer thickness varying period, the starting torque increases as the number of printed sheets increases. On the other hand, the potential difference ΔV1 may be increased in response to the increase of the number of printed sheets so as to increase the layer thickness of the toner at position P5 during the stop period. With this configuration, it is possible to restrict the starting torque from increasing in response to an increase of the contact friction of the surface of the photoconductor drum 19 due to an increase of the number of printed sheets.

FIG. 6 is a table 82 showing setting examples of the potential difference ΔV1 for the layer thickness varying period in the example 1. The table 82 shows two setting examples (setting example 1 and setting example 2) of the potential difference ΔV1. The setting example 1 is an example where the potential difference ΔV1 is uniformly set to 460 V regardless of the number of printed sheets. The setting example 2 is an example where the potential difference ΔV1 when the number of printed sheets is zero is set to 460 V, the potential difference ΔV1 when the number of printed sheets has reached 5000 is set to 480 V, and the potential difference ΔV1 when the number of printed sheets has reached 10000, 20000, or 50000 is set to 500 V. It is noted that 5000 sheets, 10000 sheets, 20000 sheets, and 50000 sheets are examples of values of the threshold W1 for the number of printed sheets, and are examples of the predetermined threshold of the present disclosure. The example 2 shown in FIG. 6 is an example where the potential difference ΔV1 is uniformly set to 360 V, as in the developing period, regardless of the number of printed sheets.

The torques at the times when the number of printed sheets has reached predetermined numbers were measured for each of the setting example 2 and the comparative example 2, and the measurement results were compared. It was confirmed that, in the case of the comparative example 2, the starting torques at the times when the number of printed sheets has reached 5000, 10000, 20000, and 50000 increased by 6%, 10%, 11%, and 10% respectively from the reference torques.

On the other hand, it was confirmed that, in the case of the setting example 1, the starting torques at the times when the number of printed sheets has reached 5000, 10000, 20000, and 50000 were reduced by 17%, 12%, 13%, and 12% respectively from the reference torque. In addition, it was confirmed that, in the case of the setting example 2, the starting torque at the time when the number of printed sheets has reached 5000 was reduced by 19% from the reference torque, the starting torque at the time when the number of printed sheets has reached 10000 was reduced by 20% from the reference torque, the starting torque at the time when the number of printed sheets has reached 20000 was reduced by 18% from the reference torque, and the starting torque at the time when the number of printed sheets has reached 50000 was reduced by 19% from the reference torque.

It is noted that in these examples, the number of printed sheets in the image forming apparatus 1A is used as a parameter that is related to the increase of the contact friction, for example. However, not limited to the number of printed sheets, the time period for which the main power source of the image forming apparatus 1A is ON, and the rotation time periods of the photoconductor drum 19 and the developing roller 32 are also examples of the parameter related to the increase of the contact friction.

Second Embodiment

Next, a second embodiment of the present disclosure is described. The second embodiment differs from the first embodiment in the presence/absence of the post-development processing period and the function of the control portion 100, and otherwise is the same as the first embodiment. As a result, in the following, only the differences from the first embodiment are described.

In the present embodiment, a control portion 200 (the driving control portion 101) causes the toner having the first layer thickness TH1 to be carried until a predetermined timing that satisfies both a first condition and a second condition. The first condition is that the timing at which the toner having the second layer thickness TH2 reaches position P5 is earlier than the timing at which the rotation of the developing roller 32 is stopped, by at least a conveyance time period TL1 that is required to convey the toner from position P2 to position P5. The second condition is that the toner having the second layer thickness TH2 reaches position P5 later than the timing at which the rear end portion of the electrostatic latent image reaches position P5. The control portion 200 (the driving control portion 101) causes the toner having the second layer thickness TH2 to be carried at the predetermined timing.

Figure 7:
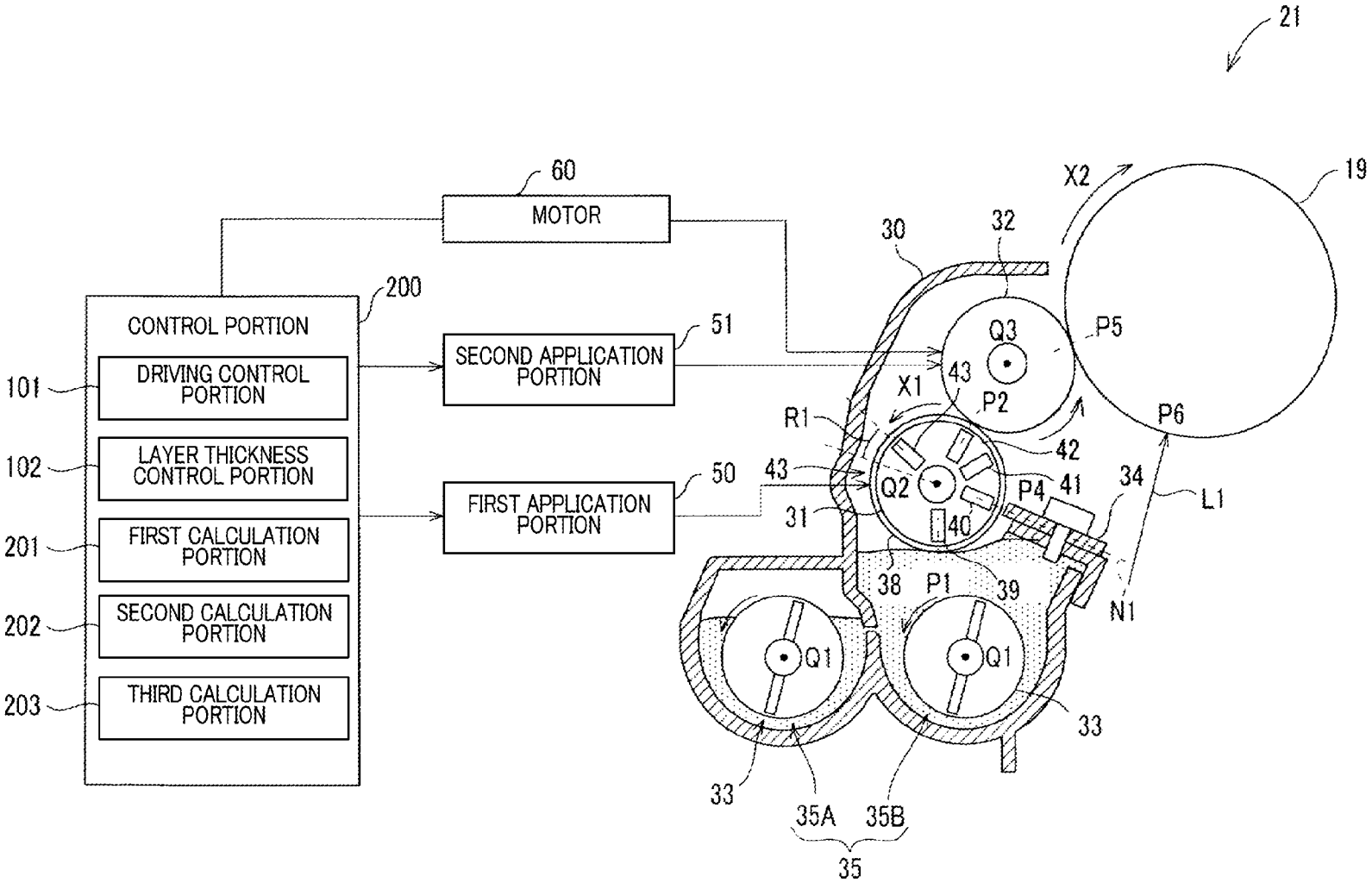
FIG. 7 is a schematic diagram showing a configuration of an image forming apparatus according to a second embodiment of the present disclosure.

Specifically, as shown in FIG. 7, the control portion 200 further includes a first calculation portion 201, a second calculation portion 202, and a third calculation portion 203.

Figure 8:
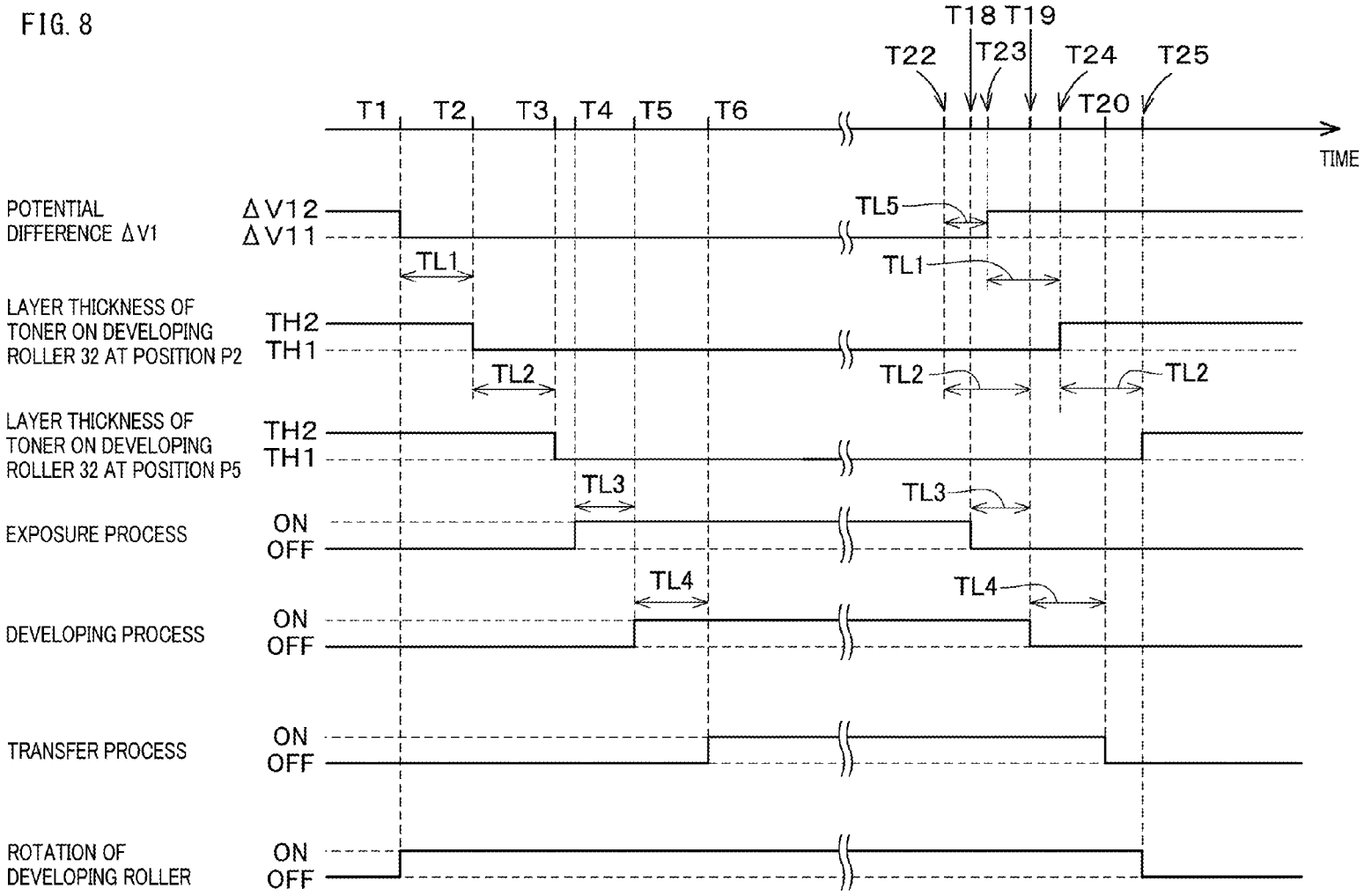
FIG. 8 is a timing chart showing timings of variation of the potential difference ΔV1, variation of layer thickness of toner on the developing roller at position P2, variation of layer thickness of toner on the developing roller at position P5, the exposure process, the developing process, the transfer process, the post-development process, and the rotation operation of the developing roller according to the second embodiment of the present disclosure.

In the following, the layer thickness control process executed by the control portion 200 of the present disclosure is described. FIG. 8 is a timing chart showing the layer thickness control process. It is noted that the timing chart of the present embodiment is the same as the timing chart of FIG. 3 up to the time T7, thus description of the same part is omitted, and the process after the time T7 is described. It is noted that, in FIG. 8, "ON" indicates that the process is executed, and "OFF" indicates that the process is stopped.

As shown in FIG. 8, at time T18, the control portion 200 causes the optical scanning portion 5 to end forming the electrostatic latent image. The time T18 has been calculated by the first calculation portion 201 in advance. That is, upon receiving an image forming job, the first calculation portion 201 calculates, in advance, a time required to form an electrostatic latent image in correspondence with image data included in the image forming job, based on the data amount of the image data. The time T18 is an example of the first timing of the present disclosure.

At time T19, at which the time period TL3 has elapsed since the time T18, the rear end portion of the electrostatic latent image reaches position P5. At time T19, the developing process, namely, the developing period ends. The time T19 is an example of the second timing of the present disclosure. The second calculation portion 202 calculates the time T19 in advance when the image forming job is received, based on the time T18 calculated by the first calculation portion 201. At time T20, at which the time period TL4 has elapsed since the time T19, the rear end portion of the toner image is transferred to the intermediate transfer belt 9, and the transfer process ends.

Upon receiving the image forming job, the third calculation portion 203 calculates in advance a time T22 that is earlier, by the conveyance time period TL2, than the time T19 calculated by the second calculation portion 202. The time T22 is an example of the third timing of the present disclosure. At time T23, at which the predetermined time period TL5 has elapsed since the time T22, the layer thickness control portion 102 sets the potential difference ΔV1 between the magnetic roller 31 and the developing roller 32 to the potential difference ΔV12 by controlling the first application portion 50 and the second application portion 51. The time T23 is an example of the fourth timing of the present disclosure. Due to this, at time T24, at which the time period TL1 has elapsed since the time T23, the thickness of the toner at position P2 on the circumferential surface of the developing roller 32 is varied to the second layer thickness TH2. It is noted that if the potential difference ΔV1 is set to the potential difference ΔV12 before the time T22, the developing process of the electrostatic latent image is executed with the toner having the second layer thickness TH2. In that case, a so-called "fogging" may occur. As a result, the time at which the potential difference ΔV1 is set to the potential difference ΔV12 needs to be after the time T22. This condition is the first condition. Subsequently, at time T25, at which the time period TL2 has elapsed since the time T24, the toner having the second layer thickness TH2 on the developing roller 32 reaches position P5 on the developing roller 32. The second condition indicates that the time T25 is later than the time T19. At the time T25, the driving control portion 101 stops the rotation of the developing roller 32. The time period from the time T19 to the time T25 is an example of the predetermined set time of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

a rotator rotatably supported and configured to receive toner at a predetermined reception position, carry and convey the toner to a contact position at which the rotator contacts an image carrying member on which an electrostatic latent image is formed based on image data, and supply the toner to the image carrying member at the contact position;

a driving control portion configured to control rotation of the rotator so as to rotate the rotator during a developing period in which the electrostatic latent image is developed, and stop the rotation of the rotator after a predetermined set time has elapsed since an end of the developing period; and a layer thickness control portion configured to cause the rotator to carry the toner by controlling a potential difference between a potential of the rotator and a predetermined potential so that the toner on the rotator at the contact position has a first layer thickness during the developing period and has a second layer thickness while the rotation of the rotator is stopped, the second layer thickness being thicker than the first layer thickness.

2. The image forming apparatus according to claim 1, wherein the set time includes a first time and a second time, the first time being required to clean the image carrying member by removing, from a surface of the image carrying member, toner that has remained on the surface after a toner image that had been formed by developing the electrostatic latent image, was transferred from the image carrying member to a predetermined transfer object, the second time following the first time, the layer thickness control portion changes a thickness of the toner from the first layer thickness to the second layer thickness after the first time has elapsed and before the second time elapses, and the driving control portion rotates the rotator for a time period after causing the rotator to carry toner having the second layer thickness until at least a conveyance time period elapses, the conveyance time period being a time period required to convey the toner from the reception position to the contact position.

3. The image forming apparatus according to claim 1, further comprising:

a first calculation portion configured to calculate, based on a data amount of the image data, a first timing at which formation of the electrostatic latent image on the image carrying member ends;

a second calculation portion configured to calculate, based on the first timing, a second timing at which the developing period corresponding to the image data ends; and a third calculation portion configured to calculate a third timing that is earlier than the second timing by a conveyance time period that is required to convey the toner from the reception position to the contact position, wherein the layer thickness control portion causes the rotator to carry toner having the second layer thickness at a fourth timing at which a predetermined time period has elapsed since the third timing, and the driving control portion rotates the rotator for a time period from the fourth timing until at least the conveyance time period elapses.

4. The image forming apparatus according to claim 1, wherein the layer thickness control portion maintains a layer thickness of the toner carried on the rotator to the second layer thickness for a time period from a time when the layer thickness of the toner is changed from the first layer thickness to the second layer thickness, until the rotation is stopped.

5. The image forming apparatus according to claim 1, wherein the layer thickness control portion causes the rotator to carry toner having a third layer thickness that is thinner than the first layer thickness, for a time period from an end of the developing period until a layer thickness of the toner is changed from the first layer thickness to the second layer thickness.

6. The image forming apparatus according to claim 1, wherein the layer thickness control portion changes a layer thickness of the toner from the second layer thickness to a fourth layer thickness that is thicker than the second layer thickness in response to an increase of a contact friction between a surface of the image carrying member and a surface of the rotator.

7. The image forming apparatus according to claim 6, wherein the contact friction increases in response to an increase of the number of printed sheets in the image forming apparatus, and the layer thickness control portion changes the layer thickness of the toner from the second layer thickness to the fourth layer thickness when the number of printed sheets reaches a predetermined threshold.

8. The image forming apparatus according to claim 1, wherein the second layer thickness is thicker than the first layer thickness and thinner than twice the first layer thickness.

9. The image forming apparatus according to claim 1, wherein the rotator and the image carrying member rotate in reverse directions to each other.

10. A developing device, comprising:

a rotator rotatably supported and configured to receive toner at a predetermined reception position, carry and convey the toner to a contact position at which the rotator contacts an image carrying member on which an electrostatic latent image is formed based on image data, and supply the toner to the image carrying member at the contact position;

a driving control portion configured to control rotation of the rotator so as to rotate the rotator during a developing period in which the electrostatic latent image is developed, and stop the rotation of the rotator after a predetermined set time has elapsed since an end of the developing period; and a layer thickness control portion configured to cause the rotator to carry the toner by controlling a potential difference between a potential of the rotator and a predetermined potential so that the toner on the rotator at the contact position has a first layer thickness during the developing period and has a second layer thickness while the rotation of the rotator is stopped, the second layer thickness being thicker than the first layer thickness.

* * * * *